United States Patent [19]

Garrison

[11] 4,046,293

[45] Sept. 6, 1977

[54] DETACHABLE BAR FOR GARMENT HANGER

[75] Inventor: Judd F. Garrison, Grand Rapids, Mich.

[73] Assignee: John Thomas Batts, Inc., Zeeland, Mich.

[21] Appl. No.: 709,460

[22] Filed: July 28, 1976

[51] Int. Cl.[2] ..... A47J 51/097

[52] U.S. Cl. ..... 223/88

[58] Field of Search ..... 223/85, 88, 89, 91, 223/95, 98; 211/113, 123

[56] References Cited

U.S. PATENT DOCUMENTS

| | | | |
|---|---|---|---|
| 2,810,050 | 10/1957 | Wingate | 223/89 |
| 3,378,219 | 4/1968 | Biesecker | 211/123 X |
| 3,478,943 | 11/1969 | Bobrow | 223/88 |
| 3,980,228 | 9/1976 | Bisk | 223/88 |

FOREIGN PATENT DOCUMENTS

| | | | |
|---|---|---|---|
| 718,478 | 10/1966 | Italy | 223/91 |

*Primary Examiner*—George H. Krizmanich

*Attorney, Agent, or Firm*—Price, Heneveld, Huizenga & Cooper

[57] ABSTRACT

A garment hanger includes a central head portion and outwardly extending arms. Each of the arms defines adjacent their ends a socket for receipt of the ends of a pants bar. The pants bar includes at each end a resilient detent finger having a barbed head. The barbed head snaps into an aperture formed in the wall of the socket to thereby positively lock the pants bar to the hanger. The pants bar is detachable upon intentional manual shifting of the resilient locking fingers.

13 Claims, 13 Drawing Figures

DETACHABLE BAR FOR GARMENT HANGER

BACKGROUND OF THE INVENTION

This invention relates to garment display devices and more particularly, to a detachable pants bar and garment hanger.

In display, storage or shipment of a variety of garment combinations such as pants and coats, slacks and blouses, etc., it is highly desirable that the garment be supported from the same hanger. In this manner, the color combinations between the matching garments are readily visible to a customer. Also, employing the same hanger reduces the amount of space required for storage or transport and prevents separation of the garments. Heretofore various garment hangers have been proposed which include a hook-supported hanger for the coat or blouse and an elongated bar extending between the arms of the hanger over which the pants or slacks may be draped.

One such hanger combination has been formed by molding the pants bar as an integral piece with the hanger during the manufacturing process. This form of hanger and pants bar is not totally acceptable in all applications since the pants bar may not be needed. Use of such an integral pants bar and hanger substantially increases the cost involved in the display, storage or shipment of garments which do not have matching pants or slacks. In an attempt to increase the versatility of a hanger and include provision for common display of a pair of pants, various forms of hangers including detachable pants bars have been proposed.

One such detachable pants bar and hanger includes a generally inverted V-shaped, hook-supported hanger having a central portion and integral arms. The ends of the arms are formed with opposed, generally horizontally extending sockets. A cylindrical pants bar is provided and is adapted to have each end inserted within the sockets. Although providing a detachable pants bar and hanger, this approach has not been totally satisfactory. For example, in order to permit ease of assembly of the pants bar to the hanger it must be formed from a fairly resilient material so that it may be bowed to permit insertion of the ends into the socket. Subsequently, when a pair of pants or slacks are draped on the bar, the bar will bow in the center resulting in a generally unsightly appearance. Further, if the weight of the pants or slacks exerts a sufficient force on the bar, the ends will slip from the sockets. This highly undesirable result may occur when the hanger and detachable pants bar combination are employed to support a single coat and more than one pair of pants or slacks. If the ends of the bar are glued or otherwise permanently secured to the sockets of the hanger after assembly, this problem would be eliminated. However, the subsequent versatility of the hanger pants bar combination is also eliminated.

Therefore, a need exists for a hanger and detachable pants bar display device wherein the bar is positively but detachably locked to the hanger in a sturdy fashion preventing detachment or deformation caused by forces exerted on the pants bar during use. Further, a need exists for a garment hanger and pants bar of the type described which is easily manufactured, simple in construction and yet is readily detachable when the hanger is to be employed for the display of coats, shirts or blouses without the display of matching pants or slacks.

SUMMARY OF THE INVENTION

In accordance with the present invention, a unique detachable pants bar and garment hanger are provided whereby the problems heretofore experienced are substantially alleviated. Essentially, the pants bar is employed with a hanger having a central head portion and outwardly extending arms. Each of the arms includes adjacent their ends socket defining means for receipt of the end of the pants bar. The ends of the pants bar include locking means for positively and detachably locking the pants bar to the hanger at the sockets.

In narrower aspects of the present invention, the sockets include at least one generally vertical wall having an aperture formed therein and the locking means include a generally upstanding, resilient locking finger having a detent head adapted to snap into the socket aperture to lockingly interconnect the pants bar to the hanger.

DETAILED DESCRIPTION OF THE PREFERRED EMBODIMENT

Figure 1:
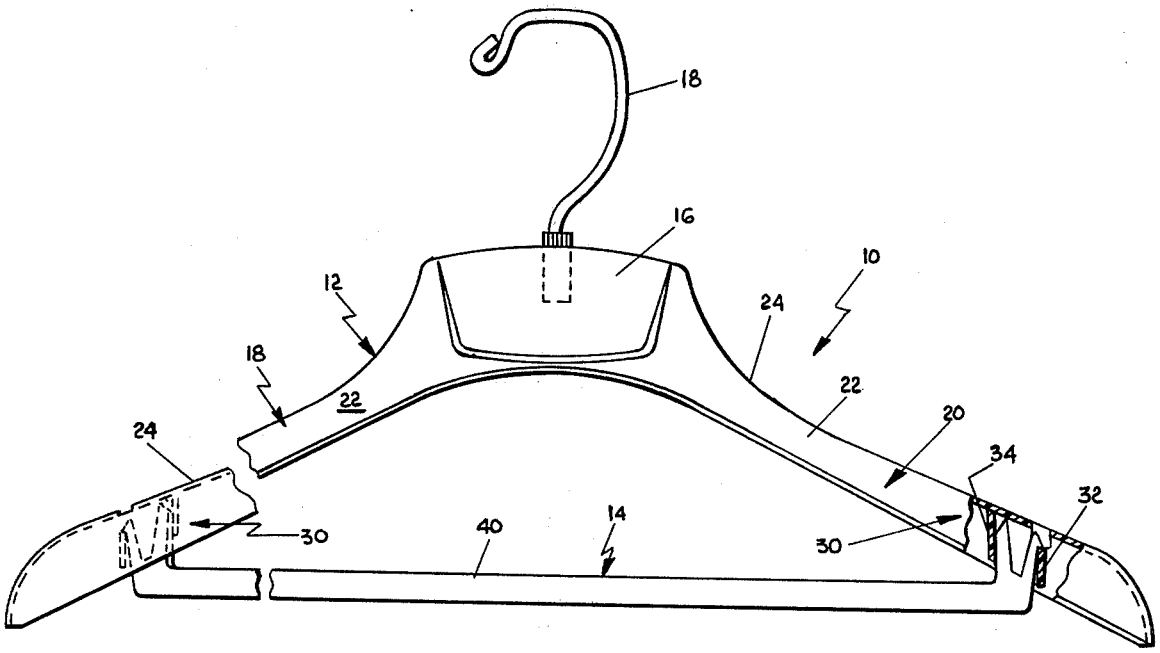
FIG. 1 is a front, elevational view in partial section of the unique hanger and detachable pants bar in accordance with the present invention.
Figure 2:
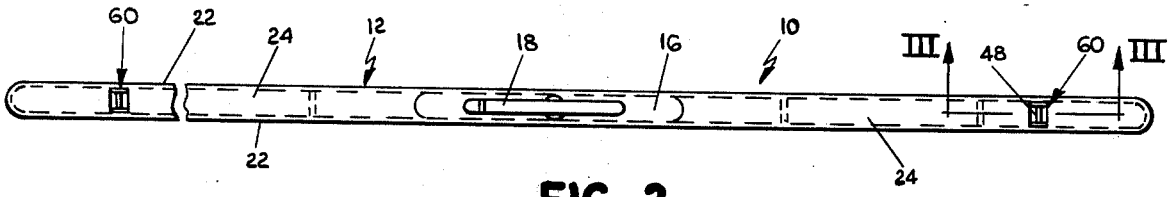
FIG. 2 is a top, plan view of the unique hanger and pants bar.
Figure 4:
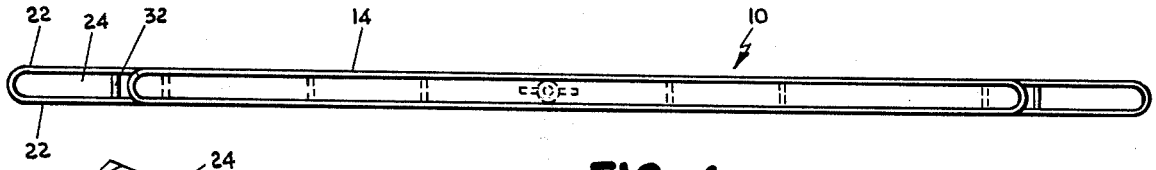
FIG. 4 is a bottom, plan view of the hanger and pants bar.

The unique garment support device in accordance with the present invention is illustrated in the drawings and generally designated 10. As best seen in FIGS. 1, 2 and 4, the device 10 includes a garment hanger 12 and a detachable pants bar 14. The hanger 12 includes a central head portion 16 to which is secured a support hook 18. Extending outwardly and downwardly from the central head 16 are support arms 18, 20. The hanger 12 is preferably injection molded from a structural plastic such as high impact polystyrene in a two-piece mold. The hanger includes front and rear walls 22 and an integral top 24. The garment hanger, therefore, defines a downwardly directed opening.

Figure 3:
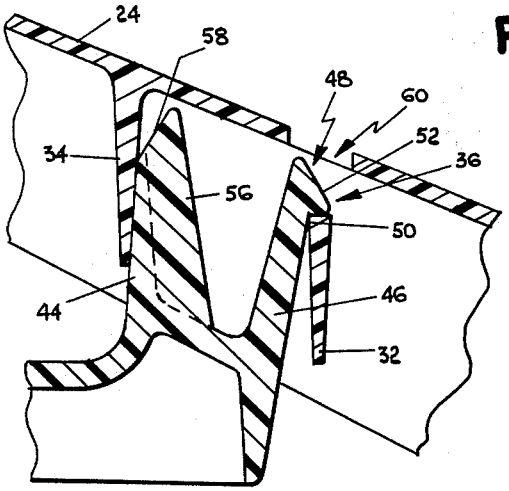
FIG. 3 is an enlarged, cross-sectional view taken generally along line III—III of FIG. 2.

Each of the arms 18, 20 includes adjacent its free outer ends a socket 30. As best seen in FIG. 3, the socket 30 is defined by a portion of the top 24, an outer wall 32 and an inner wall 34. The inner and outer walls extend transversely between the front and rear walls 22 of the hanger. The outer wall 32 extends upwardly in a generally vertical plane from a point adjacent the lower edge of the hanger arm to a point spaced from the inner surface of the hanger top 24. As a result, the outer wall 32 defines a detent aperture 36. Both the outer wall 32 and the inner wall 34 are tapered in a downwardly direction through an acute angle in order to increase the ease by which the pants bar may be attached to the hanger.

An opening is provided in the top of the hanger arm above the outer wall 32. This opening permits a shut-off portion of the mold to enter the hanger arm to mold the top of the wall 32. Thus, the body of the hanger can be molded in a simple two-piece mold without use of movable cams. As will be described subsequently, this same opening also provides access for releasing the bar 14.

As best seen in FIGS. 1 and 3, the pants bar 14 includes an elongated garment support portion or bar portion 40 and locking means 42 at each end. In the construction illustrated in FIGS. 1–5, the locking means 42 is in the form of a pair of spaced, upwardly extending fingers 44, 46. Finger 46 which is preferably formed integral with the bar 40 at the end thereof serves as a locking finger. As shown in FIG. 3, the locking finger 46 is formed with a barbed head 48 having a generally triangular shape and a base 50 having a width dimension greater than the width of the upstanding finger. The head 48, therefore, includes a barb 52 which extends outwardly from the pants bar. The barb 52 is adapted to be received within the detent or locking aperture 36 of the hanger.

In the preferred construction, the locking finger 46 is formed from a resilient, plastic material so that upon assembly, the finger will snap into the detent aperture and securely lock the pants bar to the hanger. The upstanding finger 44 includes a reinforcement rib 56 and a beveled top edge 58. The finger 44 extends upwardly from the pants bar in a generally vertical plane perpendicular to the bar 40 and is spaced from the locking or detent finger 46 so as to abut the inner surface of the inner wall 34 of the hanger. In this manner, the finger 44 provides additional support to the pants bar connection. The pants bar will, therefore, resist deflection or bowing of the support portion in use.

Figure 5:
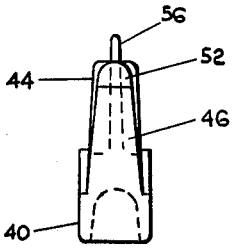
FIG. 5 is a right innovational view of the pants bar of FIGS. 1–4.

As best seen in FIGS. 1, 4 and 5, the pants bar 14 in this embodiment has a generally inverted U-shape in vertical cross section. As a result, the pants bar may be inexpensively mass produced employing conventional injection molding processes in a two-piece mold without the use of separate cams or other such devices. The preferred material is a high impact polystyrene.

As best seen in FIGS. 1, 2 and 3, the top 20 of the hanger is preferably formed with access apertures 60 directly above the outer walls 32 of the socket. The access apertures 60 permit access to the barbed head 48 of the resilient detent or locking finger. Manual shifting of the head may then be accomplished through the use of a hand tool such as a small screwdriver or pen. The tool is inserted through the access aperture and the resilient finger 46 is shifted towards the center of the hanger so that the head 48 may be disengaged from the wall 32. Then, upon pulling of the pants bar the locking fingers may be removed from the sockets.

In use, the ends of the pants bar are snapped fit into the sockets. The tapering of the walls 32, 34, the use of a triangular shaped head 48 and the beveling at 58 of the rib 56 permit each end of the pants bar to be easily inserted within the socket. Once in position, the ends of the pants bar are positively locked to the hanger. Any weight imposed on the elongated portion 40 tending to deflect or bow the bar is resisted by the combined cooperation of legs 46, 44 and socket defining walls 32 and 34. This arrangement results in a much more rigid interconnection than has heretofore been provided. There is no tendency for the pants bar to disengage from the hanger when loads are imposed on the bar. This structure combines the advantages of a permanently interconnected pants bar and hanger and more conventional detachable pants bar and hanger constructions.

ALTERNATIVE EMBODIMENTS

Figure 6:
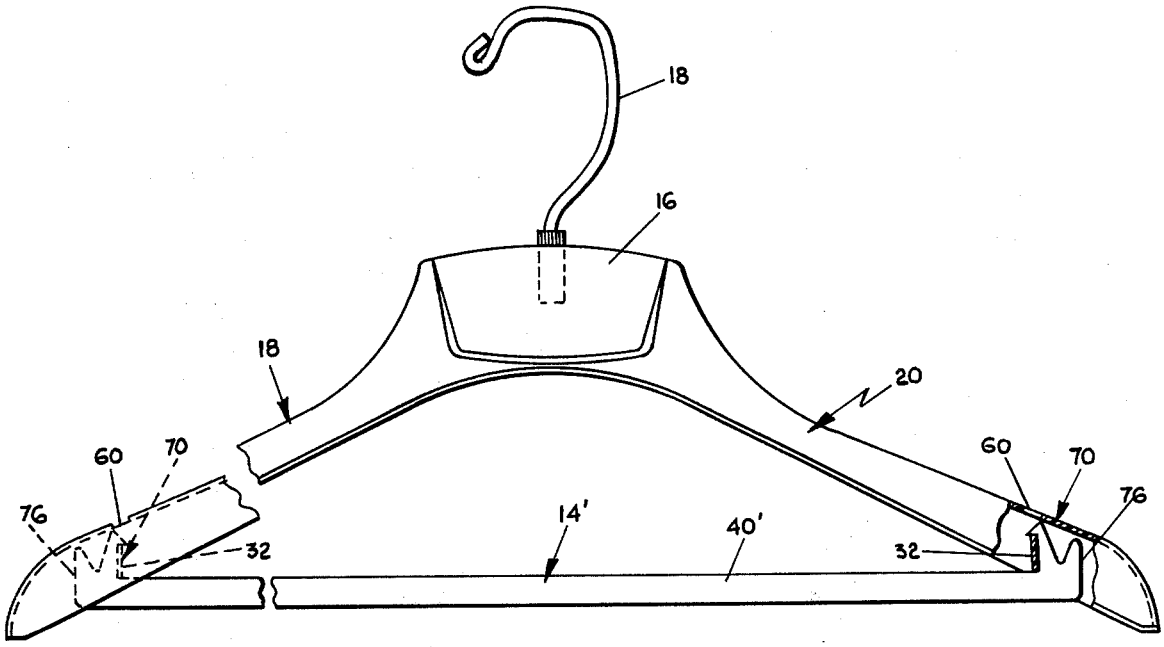
FIG. 6 is a front, partially sectioned elevational view of the hanger of FIGS. 1–4 including an alternative detachable pants bar.
Figure 7:
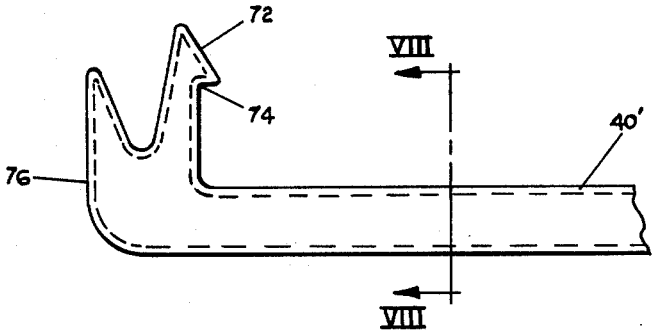
FIG. 7 is a fragmentary, front, elevational view of the alternative detachable pants bar.
Figure 8:
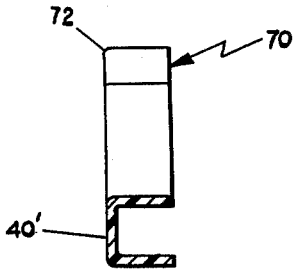
FIG. 8 is a cross-sectional view taken generally along line VIII—VIII of FIG. 7.

As best seen in FIGS. 6, 7 and 8, an alternative pants bar 14' may be employed with the hanger 12. With this embodiment, the pants bar 14' also includes an elongated portion 40' and means on each end for positively locking the pants bar to the hanger. This arrangement includes a locking or detent finger 70 which is spaced from the end of the elongated portion 40 of the pants bar. The locking finger 70 is similarly configured so as to include a generally triangular shaped head 72 which defined a barb 74. However, the barb 74 extends toward the center of the hanger as opposed to the outwardly directed barb of the previous embodiment. The pants bar 14' is provided with an upstanding leg 76 immediately adjacent its end. The leg 76 is dimensioned so as to bear on the undersurface of the top 24 of each hanger arm when the pants bar is installed. As best seen in FIG. 6, the inner surface 76 of the leg 70 abuts the outer surface of the outer wall 32 of the hanger. The pants bar 14' is installed by pressing it upwardly thereby initially expanding or deforming the flexible legs 70 outwardly. Once the barbed head 72 reaches the detent aperture 36 it snaps into place within the aperture thereby locking the bar to the hanger. Cooperation between the leg 70 and the outer wall 32 serves to resist bowing of the pants bar and prevents disengagement of the bar from the hanger during use.

As best seen in FIG. 8, the alternative pants bar 14' has a generally C-shape in cross section and is also readily formable on a mass basis by conventional injection molding processes using a two-piece mold. This alternative arrangement differs from the previous embodiment primarily in that the inner leg or finger acts at the locking detent. In the previous embodiment, the outer finger formed adjacent the end of the pants bar served as the resilient locking or detent finger. With the alternative embodiment, the upstanding finger 76 since it is in engagement with the undersurface of the top 24 of the hanger also resists bowing or any tendency of the pants bar to be deformed or to separate from the hanger during use.

Figure 9:
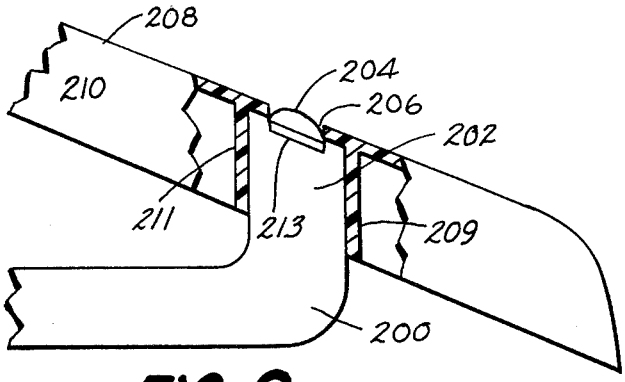
FIG. 9 is a fragmentary, partially sectioned front, elevational view of a further alternative hanger and detachable pants bar in accordance with the present invention.
Figure 10:
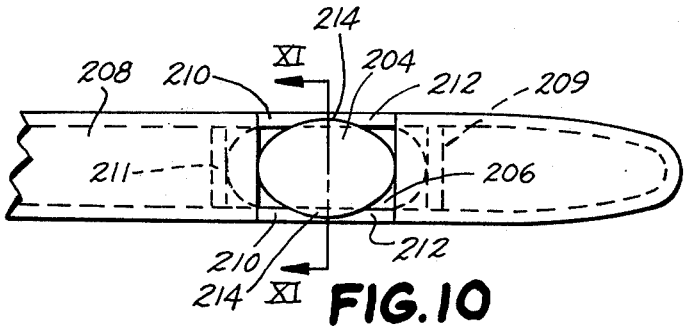
FIG. 10 is a fragmentary, top, plan view of the alternative hanger and detachable pants bar of FIG. 9.
Figure 11:
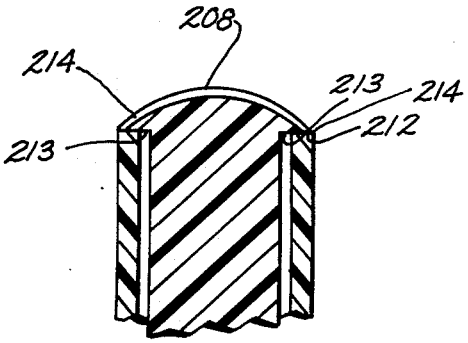
FIG. 11 is a cross-sectional view taken along line XI—XI of FIG. 10.

Another alternative embodiment of the present invention is illustrated in FIGS. 9, 10 and 11. As shown therein, a detachable pants bar 200 is provided at each end with an upstanding leg 202. The leg includes a longitudinal, barbed head detent 204 adapted to detachably secure the end of the pants bar within an upper detent aperture or socket 206 formed through the top surface 208 of the molded hanger.

As best seen in FIG. 10, the aperture 206 extends across the sides 210 of the hanger. Therefore, the hanger defines detent ledges or shoulders 212 adjacent the aperture or socket 206. The detent head 204 is molded integral with the leg 202 of the detachable pants bar and extends outwardly and upwardly from the leg of the pants bar and includes curved lateral edges 214. The detent therefore includes shoulder abutting barbs 213. When the detent 204 is pushed upwardly into the aperture 206, the edges 214 will snap through the aperture and the barbs will engage the shoulders 212. The curved configuration increases the ease of assembly. The hanger is molded from a semi-rigid plastic material having sufficient resilience to permit the detent flange 204 to snap through the upper detent aperture. Transverse outer and inner walls 209, 211 may also be provided to increase the rigidity of the structure. These walls are spaced to engage the lateral edges of the upstanding leg 202.

Figure 12:
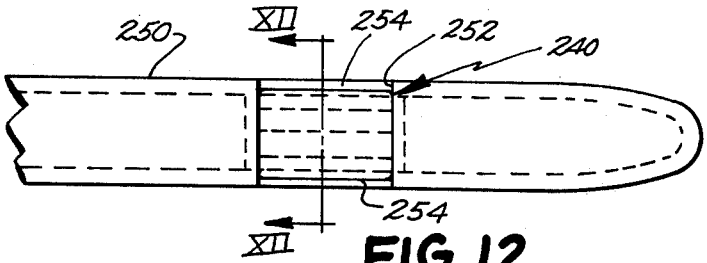
FIG. 12 is a top, fragmentary, plan view of another further alternative embodiment of the detachable pants bar and hanger in accordance with the present invention.
Figure 13:
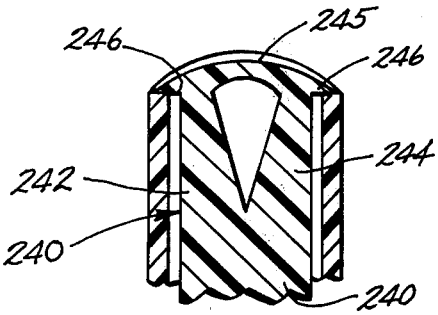
FIG. 13 is an enlarged, cross-sectional view taken generally along line XII—XII of FIG. 11.

A further alternative embodiment of the detachable pants bar and hanger in accordance with the present invention is illustrated in FIGS. 12 and 13. As shown therein, the detachable bar is formed with an upstanding leg 240 at each end. The leg 240 is bifurcated to define upstanding, longitudinal detent legs 242 and 244. The detent legs may be joined by an integral resilient web 245. The hanger arm 250 includes an aperture or socket 252 which is basically the same as aperture 206 of the hanger of FIGS. 9 and 10. The hanger, therefore, defines detent shoulders 254 adjacent the longitudinal edges of the aperture. The ends of the detent fingers 242, 244 are formed with outwardly and longitudinally extending barbs 246. In use, the end of the detachable pants bar is pushed upwardly into the aperture. The detent legs 242, 244 and member 245 are resilient enough to permit the legs to flex towards each other permitting the barbed ends 246 to pass through the aperture. Once pushed up through the aperture, the legs will snap outwardly. Withdrawal of the ends of the pants bar will be prevented by engagement of the barbed ends 246 with the shoulders 254 of the hanger.

The alternative embodiments illustrated in FIGS. 9–13 therefore each include barbed detents with the barbed portions extending parallel to the longitudinal center line of the detachable pants bar. The barbs of the resilient detent fingers of the embodiments illustrated in FIGS. 1–8, however, extend transversely to the longitudinal center line of the pants bar. With all of the embodiments, locking means are provided at each end of the support bar of the detachable pants bar which positively and detachably lock the pants bar to the hanger in the area of a detent socket. With the embodiments shown in FIGS. 9–13, the access aperture in effect serves as the detent aperture and socket. Although, the transverse walls further defining the socket may be eliminated in the embodiments of FIGS. 9–13, the bar is more rigidly retained if the walls are included.

As should now be readily apparent, the unique detachable pants bar and hanger in accordance with the present invention provides the strength advantages of an integral pants bar and hanger or a construction wherein the pants bar is a separate piece but is permanently affixed to the hanger. Also, the present invention provides all of the advantages attendant to providing a pants bar which may be detached from the hanger when not required for the specific display or storage use. This feature substantially reduces the required inventory for a clothier and results in a wide versatility of use of a standard hanger.

It should be expected that one of ordinary skill in the art will be capable of making various modifications in the embodiments illustrated without departing from the inventive concepts herein disclosed. Therefore, the above description should be considered as that of the preferred embodiments only. The true spirit and scope of the present invention will be determined by reference to the appended claims.

The embodiments of the invention in which an exclusive property or privilege is claimed are defined as follows.

1. In combination, a garment hanger and an improved detachable pants bar, said garment hanger including a central head portion and outwardly extending arms, the arms including means defining a socket adjacent the end thereof for receipt of the pants bar, and wherein said pants bar comprises:

an elongated support bar; and upstanding locking means at each end of said support bar and extending generally perpendicular to said support bar for positively and detachably locking said pants bar to said hanger at said sockets, each of said locking means including an upstanding resilient detent finger positioned adjacent each end of said pants bar, said hanger arms further defining a detent aperture at said sockets, said resilient detent finger having a portion received in said aperture so that said pants bar is positively and rigidly locked to said hanger but may be detached therefrom upon manual shifting of said resilient detent finger, and wherein said socket defining means of said arms each includes a pair of spaced, generally vertical walls, said socket opening downwardly.

2. The improvement as defined by claim 1 wherein said hanger is molded from plastic and said arms include spaced front and rear walls joined by an integral top to thereby define a downwardly directed opening and wherein one of the walls of said socket defining means extends transversely between said front and rear walls of said arm and is spaced from the end of said arm, said one wall terminating a short distance from said top of said arm to thereby define said detent aperture; and the other wall being generally parallel to but spaced from said one of said walls and extending transversely between said front and said rear walls of said arm so that said socket opens downwardly.

3. The improvement as defined by claim 2 wherein said locking means further comprises at each end of said bar, another resilient upstanding finger integral with said bar and spaced from said detent finger and engaging the surface of one of said walls, said portion of said detent finger received in said aperture including a barbed head of generally triangular shape having a base of greater width than the width of said detent finger, said base portion engaging the upper edge of said one of said walls at said detent aperture.

4. The improvement as defined by claim 3 wherein said walls are tapered downwardly to thereby increase the ease of assembly of said bar to said hanger.

5. The improvement as defined by claim 4 wherein said detent finger is the finger closest to the end of said pants bar.

6. The improvement as defined by claim 5 wherein said pants bar is molded from plastic and has a generally inverted U-shape in cross section.

7. The improvement as defined by claim 1 wherein each arm of said hanger defines an aperture extending across a portion thereof to thereby further define said socket and wherein said upstanding finger of said locking means has an integral barbed head, said barbed head configured so as to snap through said aperture to thereby secure said bar to said hanger.

8. The improvement as defined by claim 7 wherein the barbs of said head extend longitudinally of said support bar.

9. The improvement as defined by claim 8 wherein the lateral edges of said barbed head are curved.

10. The improvement as defined by claim 1 wherein each arm of said hanger defines an aperture extending across and through a portion of the top surface thereof thereby define said socket and wherein said locking means upstanding detent finger comprises:

a bifurcated, upstanding leg said bifurcated leg thereby defining a pair of longitudinal detent legs, each of said detent legs including outwardly extending barbs whereby said leg may be snapped through said aperture and said barbs will retain said bar to said hanger.

11. The improvement as defined by claim 10 wherein said bifurcated leg further includes a web joining the free ends of said detent legs.

12. The improvement as defined by claim 11 wherein said barb of each of said detent legs extends longitudinally of said support bar.

13. A garment hanger adapted for use with a detachable pants bar, said bar being of the type including an elongated support portion and upstanding, resilient locking fingers on each end, said locking fingers each including a barbed head, said garment hanger comprising:

a central head portion;

arms extending outwardly from said head portion; and means defining a locking finger receiving socket adjacent each of the ends of said arms for receiving said detent finger, and said arms each include front and rear walls and an integral top, said arms opening in a downward direction whereby said hanger may be molded from plastic, said socket defining means including an outer wall extending between said front and rear walls of each of said arms adjacent the end thereof, said wall terminating a short distance from the undersurface of said top to thereby define a detent aperture, said barbed head of said locking finger adapted for receipt in said detent aperture, and wherein said tops each have an access aperture therein directly over said outer wall whereby access may be had to said locking finger to permit shifting thereof and detachment of said bar from said hanger.

* * * * *

UNITED STATES PATENT AND TRADEMARK OFFICE

CERTIFICATE OF CORRECTION

PATENT NO. : 4,046,293

DATED : September 6, 1977

INVENTOR(S) : Judd F. Garrison

It is certified that error appears in the above-identified patent and that said Letters Patent are hereby corrected as shown below:

Column 4, line 30:

"defined" should be --defines--

Column 7, line 19:

after "thereof" insert --to--

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*